US009393665B2

(12) United States Patent
Wang et al.

(10) Patent No.: US 9,393,665 B2
(45) Date of Patent: Jul. 19, 2016

(54) POLISHING METHOD AND POLISHING SYSTEM

(75) Inventors: Yu-Piao Wang, Hsinchu County (TW); Jen-Feng Cheng, Taichung (TW); Te-Yang Chen, Hsinchu (TW); Ya-Ling Chen, Taichung (TW)

(73) Assignees: IV TECHNOLOGIES CO., LTD., Taichung (TW); POWERCHIP TECHNOLOGY CORPORATION, Hsinchu (TW)

( * ) Notice: Subject to any disclaimer, the term of this patent is extended or adjusted under 35 U.S.C. 154(b) by 626 days.

(21) Appl. No.: 13/198,729

(22) Filed: Aug. 5, 2011

(65) Prior Publication Data

US 2012/0244785 A1 Sep. 27, 2012

(30) Foreign Application Priority Data

Mar. 21, 2011 (TW) ..... 100109552 A

(51) Int. Cl.

| | |
|---|---|
| ***B24B 1/00*** | (2006.01) |
| ***B24B 37/04*** | (2012.01) |
| ***B24B 37/10*** | (2012.01) |
| ***B24B 37/26*** | (2012.01) |

(52) U.S. Cl.

CPC ..... *B24B 37/042* (2013.01); *B24B 37/105* (2013.01); *B24B 37/26* (2013.01)

(58) Field of Classification Search

CPC ..... B24B 37/042; B24B 37/26; B24B 37/105

USPC ..... 451/41, 28, 397

See application file for complete search history.

(56) References Cited

U.S. PATENT DOCUMENTS

| | | | | |
|---|---|---|---|---|
| 4,128,968 | A * | 12/1978 | Jones | 451/5 |
| 5,131,190 | A * | 7/1992 | Gougouyan | 451/286 |
| 5,297,364 | A * | 3/1994 | Tuttle | 451/527 |
| 5,599,423 | A * | 2/1997 | Parker et al. | 438/692 |
| 5,921,855 | A * | 7/1999 | Osterheld et al. | 451/527 |
| 6,012,970 | A * | 1/2000 | Nagabushnam et al. | 451/41 |
| 6,062,958 | A * | 5/2000 | Wright et al. | 451/288 |
| 6,520,847 | B2 * | 2/2003 | Osterheld et al. | 451/527 |
| 6,585,572 | B1 * | 7/2003 | Saldana et al. | 451/67 |
| 6,640,155 | B2 * | 10/2003 | Saldana et al. | 700/164 |
| 6,994,609 | B1 * | 2/2006 | Gotkis | 451/41 |
| 7,481,695 | B2 * | 1/2009 | Saldana et al. | 451/5 |
| 7,867,066 | B2 * | 1/2011 | Suzuki | 451/527 |
| 8,118,645 | B2 * | 2/2012 | Wang | 451/41 |
| 2001/0000490 | A1 * | 4/2001 | Hashimoto et al. | 438/14 |
| 2002/0146970 | A1 * | 10/2002 | Saldana et al. | 451/285 |
| 2004/0038623 | A1 * | 2/2004 | Chandrasekaran | 451/5 |
| 2004/0072516 | A1 * | 4/2004 | Osterheld et al. | 451/285 |
| 2004/0097174 | A1 * | 5/2004 | Shirakashi et al. | 451/41 |

FOREIGN PATENT DOCUMENTS

| | | | |
|---|---|---|---|
| JP | 2000176829 | A | 6/2000 |
| JP | 2004327567 | A * | 11/2004 |
| TW | 200933719 | A | 8/2009 |

OTHER PUBLICATIONS

Taiwanese Office Action for related Taiwanese Patent Application No. 100109552 dated Oct. 14, 2015, 28 Pages.

* cited by examiner

*Primary Examiner* — Joseph J Hail
*Assistant Examiner* — Joel Crandall
(74) *Attorney, Agent, or Firm* — Ditthavong & Steiner, P.C.

(57) ABSTRACT

A polishing method and a polishing system are provided. By means of adjusting a rotational center of a polishing article corresponding to positions of a polishing pad or polishing pads, a polishing rate of the polishing article surface has a better uniformity, resulted from compensation of polishing rates at the rotational center of the polishing article.

34 Claims, 9 Drawing Sheets

POLISHING METHOD AND POLISHING SYSTEM

CROSS-REFERENCE TO RELATED APPLICATION

This application claims the priority benefit of Taiwan application serial no. 100109552, filed Mar. 21, 2011. The entirety of the above-mentioned patent application is hereby incorporated by reference herein and made a part of this specification.

BACKGROUND OF THE INVENTION

1. Field of the Invention

The invention relates to a polishing method and a polishing system. More particularly, the invention relates to a polishing system capable of providing better polishing uniformity on a surface of a polishing article and a polishing method of the same.

2. Description of Related Art

With the progress in the industry, the planarization process is often adopted for fabricating various devices. In the planarization process, the chemical mechanical polishing (CMP) process is often applied in the industry. Generally, the chemical mechanical polishing process is performed by supplying a slurry having chemical mixtures on a polishing pad, applying a pressure on the polishing article to be polished to press it on the polishing pad, and providing a relative motion between the polishing article and the polishing pad. Through the mechanical friction generated by the relative motion and the chemical effect of the polishing slurry, a portion of the surface of the planarization.

The conventional polishing pad includes a plurality of concentric circular grooves used to accommodate or remove residues or by-products generated from the polishing process, and enable a polishing article to be easily detached away from the circular polishing pad when the polishing process is completed. During the polishing process, not only does the polishing pad rotate, but the polishing article in contact with the surface of the polishing pad also rotates. However, as the concentric circular grooves on the conventional polishing pad are right circular grooves, and the polishing article rotates along an axis passing through the center point thereof as a rotational axis. Thus, when the direction between a particular point and the center point of the polishing article is perpendicular to the tangential direction of the grooves, the particular point will constantly contact a groove position or a non-groove position. For example, if the particular point contacts the groove position, points adjacent to the particular point would constantly contact the non-groove positions, thus affecting the polishing uniformity. Moreover, the above problem gets worse at positions closer to the central portion of the polishing article, as the central portion of the polishing article almost constantly contacts a specific position (for example, the groove position or the non-groove position) on the polishing pad during the whole polishing process. Therefore, the polishing rate of the central portion of the polishing article is lower or higher than the polishing rates of the other near portions, depending on whether the central portion constantly contacts the groove position or the non-groove position. The problem of non-uniform polishing rate of the polishing article may eventually degrade the reliability of the device.

Therefore, a polishing method and a polishing system are required to provide a better polishing uniformity.

SUMMARY OF THE INVENTION

The invention is directed to a polishing method and a polishing system capable of providing a better polishing uniformity on the surface of a polishing article.

The invention is directed to a polishing method including the following. A first polishing pad and a second polishing pad are provided. The first polishing pad has a plurality of first high polishing rate regions and a plurality of first low polishing rate regions. The second polishing pad has a plurality of second high polishing rate regions and a plurality of second low polishing rate regions. A polishing article is set on the first polishing pad to perform a first polishing process. Thereafter, the polishing article is moved onto the second polishing pad to perform a second polishing process. Here, a rotational center of the polishing article corresponds to one of the first high polishing rate regions during the first polishing process and corresponds to one of the second low polishing rate regions during the second polishing process. Or, the rotational center of the polishing article corresponds to one of the first low polishing rate regions during the first polishing process and corresponds to one of the second high polishing rate regions during the second polishing process.

The invention is also directed to a polishing method including the following. A polishing pad having a plurality of high polishing rate regions and a plurality of low polishing rate regions is provided. A polishing article is set on the polishing pad to perform a first polishing process. Thereafter, the polishing article is moved to perform a second polishing process. Herein, a rotational center of the polishing article corresponds to one of the first high polishing rate regions during the first polishing process and corresponds to one of the low polishing rate regions during the second polishing process. Or, the rotational center of the polishing article corresponds to one of the low polishing rate regions during the first polishing process and corresponds to one of the high polishing rate regions during the second polishing process.

The invention is further directed to a polishing method including the following. A polishing pad having a plurality of high polishing rate regions and a plurality of low polishing rate regions is provided. A polishing article is set on the polishing pad to perform a first oscillatory polishing process. When performing the first oscillatory polishing process, a rotational center of the polishing pad and a rotational center of the polishing article have a first shortest distance D1 therebetween. A second oscillatory polishing process is then performed. When performing the second oscillatory polishing process, the rotational center of the polishing pad and the rotational center of the polishing article have a second shortest distance D2 therebetween, and $D1-D2=P\times N+P\times(30\%\sim70\%)$, where P represents a distance between two adjacent low polishing rate regions and N represents an integer.

The invention is additionally directed to a polishing system suitable for polishing a polishing article. The polishing system includes a first polishing pad and a second polishing pad. The first polishing pad has a plurality of first high polishing rate regions and a plurality of first low polishing rate regions. The second polishing pad has a plurality of second high polishing rate regions and a plurality of second low polishing rate regions. Particularly, when the polishing article is set on the first polishing pad to perform a first polishing process, a rotational center of the polishing article corresponds to one of the first high polishing rate regions, and when the polishing article is moved onto the second polishing pad to perform a second polishing process, the rotational center of the polishing article corresponds to one of the second low polishing rate regions. Or, when the polishing article is set on the first polishing pad to perform a first polishing process, a rotational center of the polishing article corresponds to one of the first low polishing rate regions, and when the polishing article is moved onto the second polishing pad to perform a second polishing process, the rotational center of the polishing article corresponds to one of the second high polishing rate regions.

The invention is further directed to a polishing system including a polishing pad and a polishing article. The polishing pad includes a plurality of high polishing rate regions and a plurality of low polishing rate regions. The polishing article is set on the polishing pad. Especially, when the polishing article is set on the polishing pad to perform a first polishing process, a rotational center of the polishing article corresponds to one of the high polishing rate regions, and when the polishing article is set to the polishing pad to perform a second polishing process, the rotational center of the polishing article corresponds to one of the low polishing rate regions. Or, when the polishing article is set on the polishing pad to perform a first polishing process, a rotational center of the polishing article corresponds to one of the low polishing rate regions, and when the polishing article is set on the polishing pad to perform a second polishing process, the rotational center of the polishing article corresponds to one of the high polishing rate regions.

The invention is further directed to a polishing system including a polishing pad and a polishing article. The polishing pad has a plurality of high polishing rate regions and a plurality of low polishing rate regions. The polishing article is set on the polishing pad. In particular, when a first polishing process is performed for the polishing article on the polishing pad, a rotational center of the polishing pad and a rotational center of on the polishing pad, a rotational center of the polishing pad and a rotational center of the polishing article have a first shortest distance D1 therebetween. Moreover, when a second polishing process is performed for the polishing article on the polishing pad, the rotational center of the polishing pad and the rotational center of the polishing article have a second shortest distance D2 therebetween. Herein, $D1-D2=P\times N+P\times(30\%\sim70\%)$, and P represents a distance between two adjacent low polishing rate regions and N represents an integer.

In light of the foregoing, in the invention, the polishing rates at the rotational center of the polishing article can be compensated by one another through adjusting positions of the rotational center of the polishing article corresponding to the polishing pad, such that the polishing rate at the surface of the polishing article has a better uniformity.

In order to make the aforementioned and other features and advantages of the invention more comprehensible, several embodiments accompanied with figures are described in detail below.

BRIEF DESCRIPTION OF THE DRAWINGS

The accompanying drawings are included to provide further understanding, and are incorporated in and constitute a part of this specification. The drawings illustrate embodiments and, together with the description, serve to explain the principles of the invention.

DESCRIPTION OF EMBODIMENTS

First Embodiment

Figure 1:
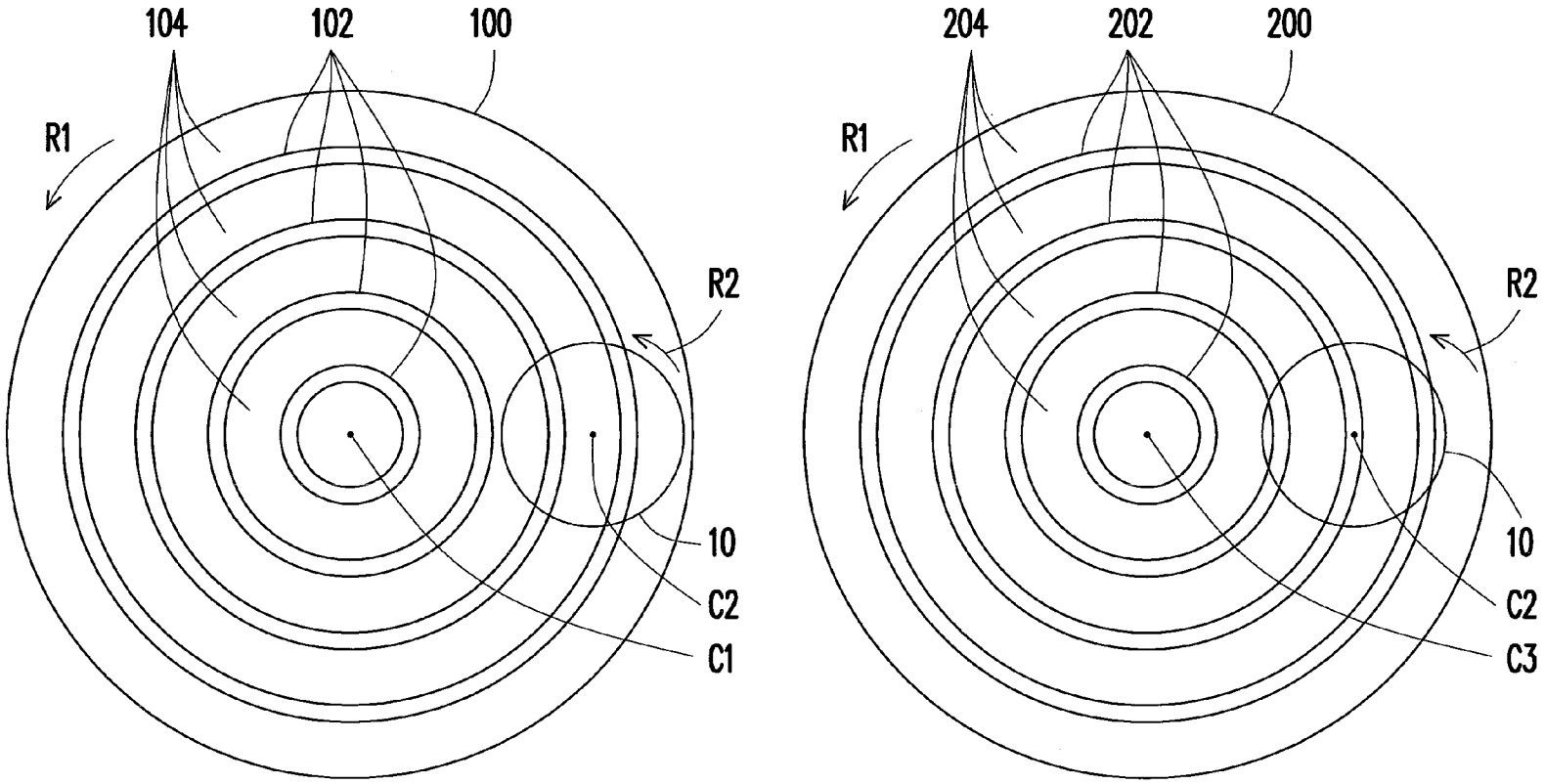
FIG. 1 illustrates a schematic top view of a polishing system according to an embodiment of the invention.
Figure 2:
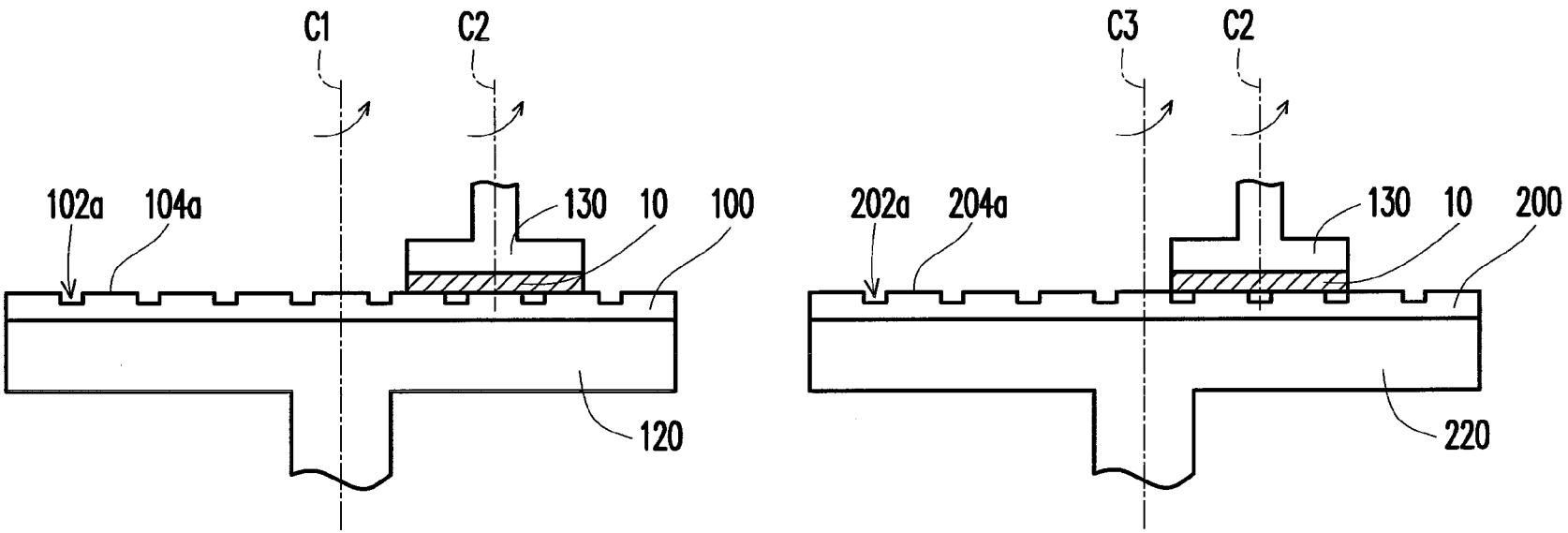
FIG. 2 illustrates a schematic side view of a polishing system according to an embodiment of the invention.

FIG. 1 illustrates a schematic top view of a polishing system according to an embodiment of the invention. FIG. 2 illustrates a schematic side view of a polishing system according to an embodiment of the invention. Referring to FIGS. 1 and 2 simultaneously, the polishing system includes a first polishing pad 100, a second polishing pad 200, and a polishing article 10. According to the present embodiment, the polishing system further includes a first platen 120, a second platen 220, and a carrier 130.

The first polishing pad 100 has a plurality of first high polishing rate regions 104 and a plurality of first low polishing rate regions 102. According to the present embodiment, at least one first groove 102*a* (as shown in FIG. 2) is disposed in the first low polishing rate regions 102 of the first polishing pad 100. Also, the first high polishing rate regions 104 of the first polishing pad 100 has a first polishing layer surface 104*a*. In addition, the first high polishing rate regions 104 and the first low polishing rate regions 102 are concentric circular regions respectively, and the first high polishing rate regions 104 and the first low polishing rate regions 102 are disposed alternately.

In the present embodiment, the first polishing pad 100 is formed by, for example, a polymer base material. The polymer base material may be synthesized by a thermosetting resin or a thermoplastic resin. In addition to the polymer base material, the first polishing pad 100 may further include conductive materials, abrasive particles, micro-spheres, or soluble additives embedded in the polymer base material. Thus, the first polishing layer surface 104*a* in the first high polishing rate regions 104 is the polymer base material surface aforementioned. Further, the first grooves 102*a* in the first low polishing rate regions 102 are, for example, concentric circular grooves mainly used to transport and distribute a polishing slurry.

The first polishing pad 100 is set on the first platen 120. In the present embodiment, the first platen 120 is a circular rotary disc. When the first platen 120 rotates, the first polishing pad 100 fixed on the surface of the first platen 120 is driven, such that the first polishing pad 100 rotates at the same time.

The second polishing pad 200 has a plurality of second high polishing rate regions 204 and a plurality of second low polishing rate regions 202. According to the present embodiment, at least one second groove 202*a* (as shown in FIG. 2) is disposed in the second low polishing rate regions 202 of the second polishing pad 200. Also, the second high polishing rate regions 204 of the second polishing pad 200 has a second polishing layer surface 204*a* (as depicted in FIG. 2). The second high polishing rate regions 204 and the second low polishing rate regions 202 are concentric circular regions respectively, and the second high polishing rate regions 204 and the second low polishing rate regions 202 are disposed alternately.

Similarly, in the present embodiment, the second polishing pad 200 is formed by, for example, a polymer base material. The polymer base material may be synthesized by a thermosetting resin or a thermoplastic resin. In addition to the polymer base material, the second polishing pad 200 may further include conductive materials, abrasive particles, microspheres, or soluble additives embedded in the polymer base material. Thus, the second polishing layer surface 204*a* in the second high polishing rate regions 204 is the polymer base material surface aforementioned. Further, the second grooves 202*a* in the second low polishing rate regions 202 are, for example, concentric circular grooves mainly used to transport and distribute a polishing slurry.

The second polishing pad 200 is set on the second platen 220. In the present embodiment, the second platen 220 is a circular rotary disc. When the second platen 220 rotates, the second polishing pad 200 fixed on the surface of the second platen 220 is driven, such that the second polishing pad 200 rotates at the same time.

The carrier 130 is disposed above the first platen 120 or the second platen 220, and used to accommodate the polishing article 10 and apply a pressure thereon to press the polishing article 10 onto a surface of the first polishing pad 100 or the second polishing pad 200. Consequently, a surface to be polished in the polishing article 10 contacts with the first polishing pad 100 or the second polishing pad 200. According to an embodiment, the carrier 130 enables the polishing article 10 to rotate on the first polishing pad 100 or the second polishing pad 200, and drives an oscillatory movement shifting the polishing article 10 back and forth on the first polishing pad 100 or the second polishing pad 200. Therefore, the contact between the polishing article 10 and the first polishing pad 100 or the second polishing pad 200 may not be confined within a certain region, thereby the polishing rate and uniformity become more stable, and the polishing process will be more even.

Accordingly, steps of a polishing method performed using the polishing system mentioned above are provided below.

Firstly, the polishing article 10 is pressed by the carrier 130 onto the first polishing pad 100 to perform a first polishing process. Then, the carrier 130 moves the polishing article 10 onto the second polishing pad 200 to perform a second polishing process. Herein, in the beginning of the first polishing process, a rotational center C2 of the polishing article 10 corresponding to a position of the first polishing pad 100 has to be set. Also, in the beginning of the second polishing process, the rotational center C2 of the polishing article 10 corresponding to a position of the second polishing pad 200 has to be set. It is noted that different corresponding positions of the rotational center C2 of the polishing article 10 respectively generate different polishing rates of the rotational center C2 of the polishing article 10. For example, when the rotational center C2 of the polishing article 10 corresponds to the high polishing rate region, the rotational center C2 of the polishing article 10 is then polished with a higher polishing rate. On the contrary, when the rotational center C2 of the polishing article 10 corresponds to the low polishing rate region, the rotational center C2 of the polishing article 10 is then polished with a lower polishing rate. It is specially noted that the polishing rates of the polishing article 10 in the first and second polishing processes can be compensated, so that an overall surface of the polishing article 10 (including the rotational center and other portions) has a better uniformity upon completion of the entire polishing process. In details, when the rotational center C2 of the polishing article 10 is selectively set corresponding to the first high polishing rate region 104 in the first polishing process, the rotational center C2 of the polishing article 10 has to be set corresponding to the second low polishing rate region 202 in the second polishing process. Conversely, when the rotational center C2 of the rotational article 10 is selectively set corresponding to the first low polishing rate region 102 in the first polishing process, the rotational center C2 of the polishing article 10 has to be set corresponding to the second high polishing rate region 204 in the second polishing process. In the detailed description below, the corresponding position of the rotational center C2 of the polishing article corresponds to the first high polishing rate region 104 in the first polishing process and corresponds to the second low polishing rate region 202 in the second polishing process. However, the scope of the invention is not limited thereto.

In the present embodiment, the rotational center C2 of the polishing article 10 is set corresponding to one of a plurality of high polishing rate regions 104 in the first polishing process. Specifically, when performing the first polishing process, the first platen 120 enables the first polishing pad 100 to rotate along a direction R1. Here, rotating along the direction R1 is, for example, rotating in a counter-clockwise direction along a rotational center C1 of the first polishing pad 100. The carrier 130 enables the polishing article 10 to rotate along a direction R2. Here, rotating along the direction R2 is, for example, rotating in a counter-clockwise direction along the rotational center C2 of the polishing article 10. During the first polishing process, the rotational center C2 of the polishing article 10 constantly corresponds to the first high polishing rate region 104 of the first polishing pad 100 (that is, the polishing layer surface 104*a*). Since the rotational center C2 of the polishing article 10 almost constantly contacts the same position during the first polishing process, the rotational center C2 of the polishing article 10 polishes at a relatively higher polishing rate in the first polishing process.

After the first polishing process is completed, the carrier 130 moves the polishing article 10 to the second polishing pad 200 to perform the second polishing process. Here, the rotational center C2 of the polishing article 10 is set corresponding to one of a plurality of second low polishing rate regions 202. Specifically, when performing the second polishing process, the second platen 220 enables the second polishing pad 200 to rotate along a direction R1. Here, rotating along the direction R1 is, for example, rotating in a counter-clockwise direction along a rotational center C3 of the second polishing pad 200. The carrier 130 enables the polishing article 10 to rotate along a direction R2. Here, rotating along the direction R2 is, for example, rotating in a counter-clockwise direction along the rotational center C2 of the polishing article 10. During the second polishing process, the rotational center C2 of the polishing article 10 constantly corresponds to the second low polishing rate region 202 of the second polishing pad 200 (that is, the groove 202*a*). Since the rotational center C2 of the polishing article 10 almost constantly contacts the same position during the second polishing process, the rotational center C2 of the polishing article 10 polishes at a relatively lower polishing rate in the second polishing process.

Figure 3:
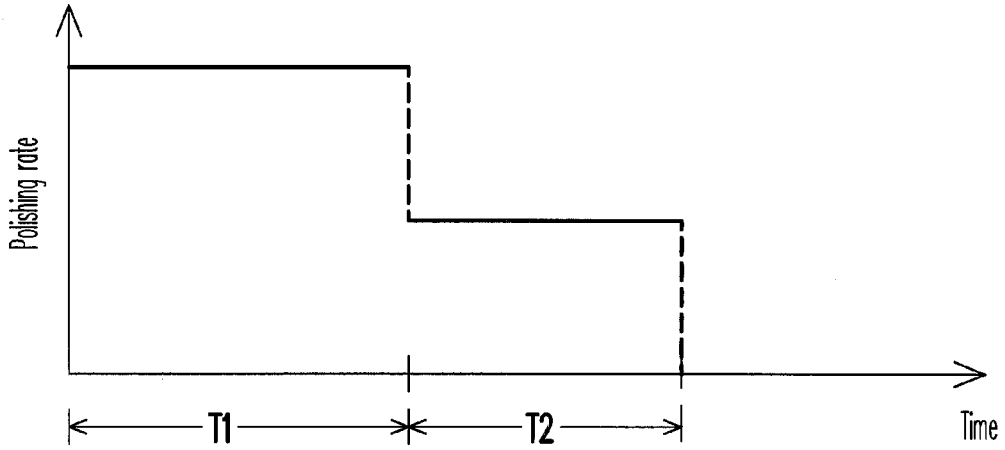
FIG. 3 is a graph showing a relationship of a polishing rate at a rotational center of a polishing article versus time when the polishing system in FIGS. 1 and 2 performs a polishing process.

FIG. 3 is a graph showing a relationship of a polishing rate at a rotational center of a polishing article versus time when the polishing system in FIGS. 1 and 2 performs a polishing process. According to an embodiment of the invention, referring to FIG. 3, the polishing article 10 is disposed on the first polishing pad 100 to perform the first polishing process with a polishing time T1, and the polishing article 10 is disposed on the second polishing pad 200 to perform the second polishing process with a polishing time T2. Particularly, the polishing time T1 in the first polishing process accounts for 30%-70% (or 40%-60%, or even 50%) of a total polishing time T1+T2.

Accordingly, as shown in FIG. 3, the rotational center C2 of the polishing article 10 polishes at a relatively higher polishing rate during the first polishing process (that is, in the polishing time T1 interval). This is due to that the rotational center C2 of the polishing article 10 almost constantly contacts the first high polishing rate region 104 of the first polishing pad 100 (that is, the polishing layer surface 104*a*) during the first polishing process. The rotational center C2 of the polishing article 10 polishes at a relatively lower polishing rate during the second polishing process (that is, in the polishing time T2 interval). This is due to that the rotational center C2 of the polishing article 10 almost constantly contacts the second low polishing rate region 202 of the second polishing pad 200 (that is, the groove 202*a*) during the second polishing process. In other words, the polishing rate of the rotational center C2 of the polishing article 10 in the first polishing process and the polishing rate of the rotational center C2 of the polishing article 10 in the second polishing process can compensate each other. Therefore, after the first and the second polishing processes are performed, the polishing rate of the rotational center C2 of the polishing article 10 approaches the polishing rates at other positions of the polishing article 10, such that a better uniformity of the polishing rate on the surface of the polishing article 10 is attained.

Figure 4:
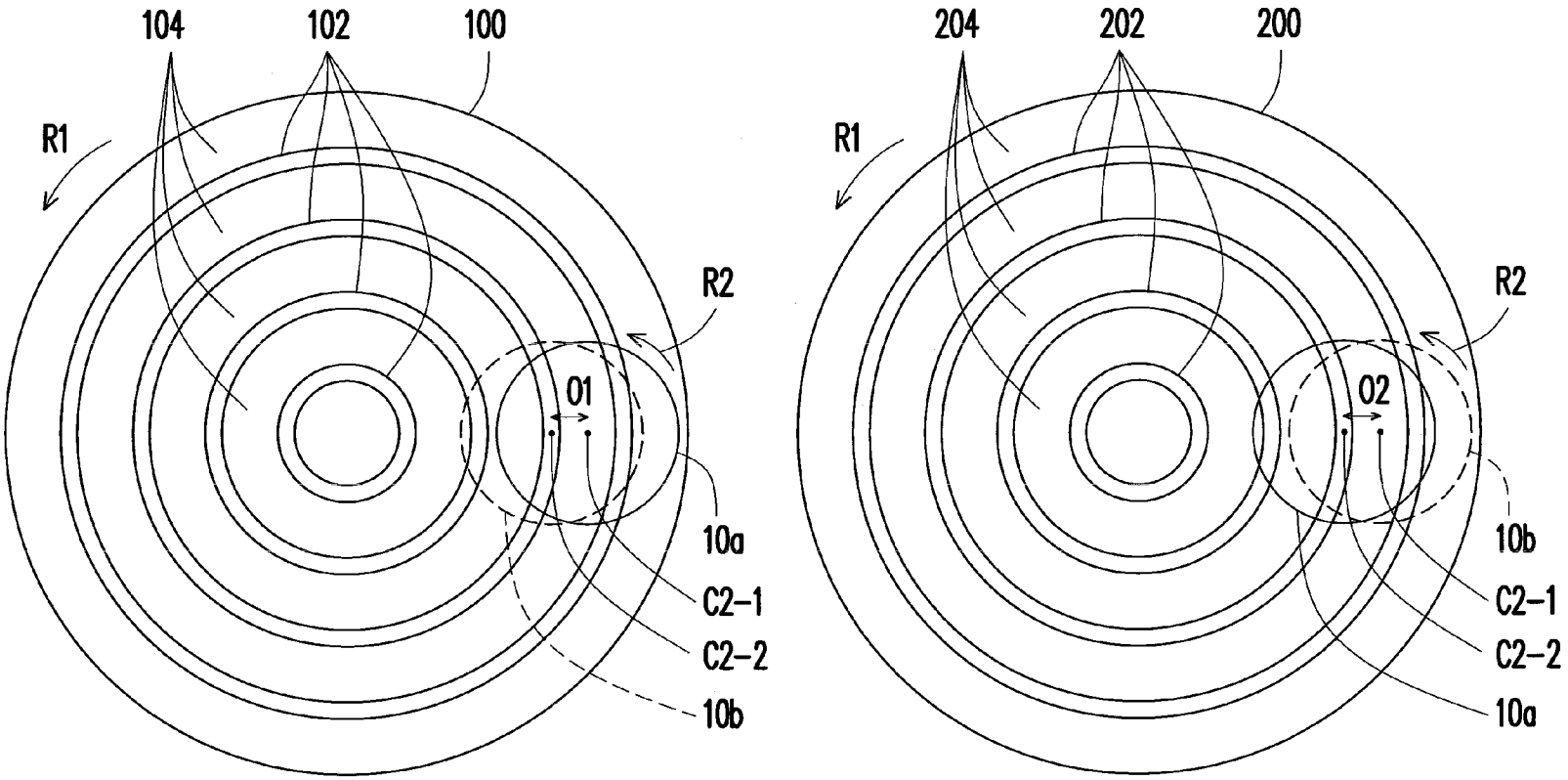
FIG. 4 illustrates a schematic top view of a polishing system according to an embodiment of the invention.

FIG. 4 illustrates a schematic top view of a polishing system according to another embodiment of the invention. Referring to FIG. 4, a polishing system in FIG. 4 is similar to the polishing system in FIGS. 1 and 2, and the same elements as those in FIGS. 1 and 2 are denoted with the same notations and the details are omitted hereinafter. The polishing system in FIG. 4 and the polishing system in FIGS. 1 and 2 are different in that an oscillatory polishing step is further performed for the polishing article 10 (also for the carrier 130) in the polishing process. In other words, when performing the first polishing process on the first polishing pad 100, the polishing article 10 (the carrier 130) further performs an oscillatory polishing step O1; that is, the polishing article rotates along the direction R2 and oscillates back and forth between a position 10*a* and a position 10*b* for polishing. When the polishing article 10 oscillates back and forth between the position 10*a* and the position 10*b*, the rotational center thereof also oscillates back and forth between a position C2-1 and a position C2-2.

Similarly, when the polishing article 10 (the carrier 130) is moved to the second polishing pad 200 to perform the second polishing process, an oscillatory polishing step O2 is further performed for the polishing article 10 (also for the carrier 130). That is, the polishing article 10 rotates along the direction R2 and oscillates between the position 10*a* and the position 10*b* for polishing. When the polishing article 10 oscillates back and forth between the position 10*a* and the position 10*b*, the rotational center thereof also oscillates back and forth between the position C2-1 and the position C2-2.

Figure 5A:
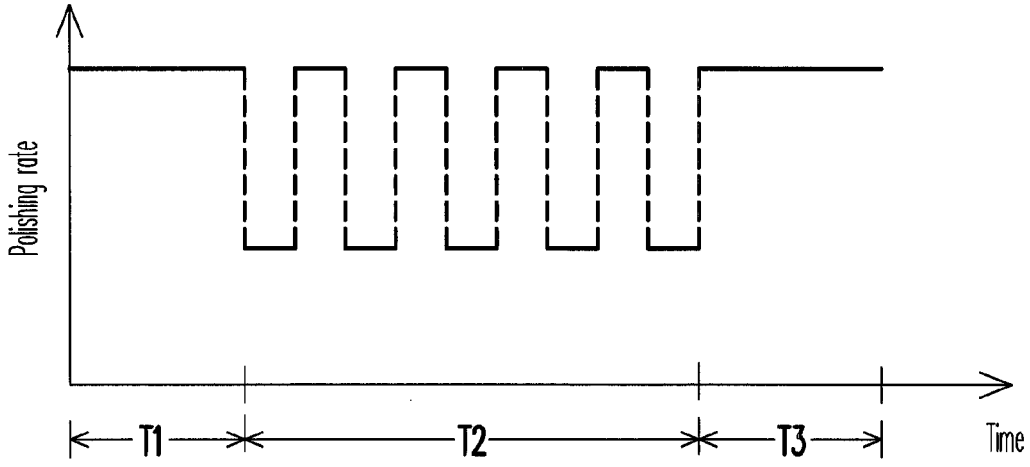
FIG. 5A is a graph showing a relationship of a polishing rate at a rotational center of a polishing article versus time when applying the polishing system in FIG. 4 to perform a first polishing process according to another embodiment of the invention.
Figure 5B:
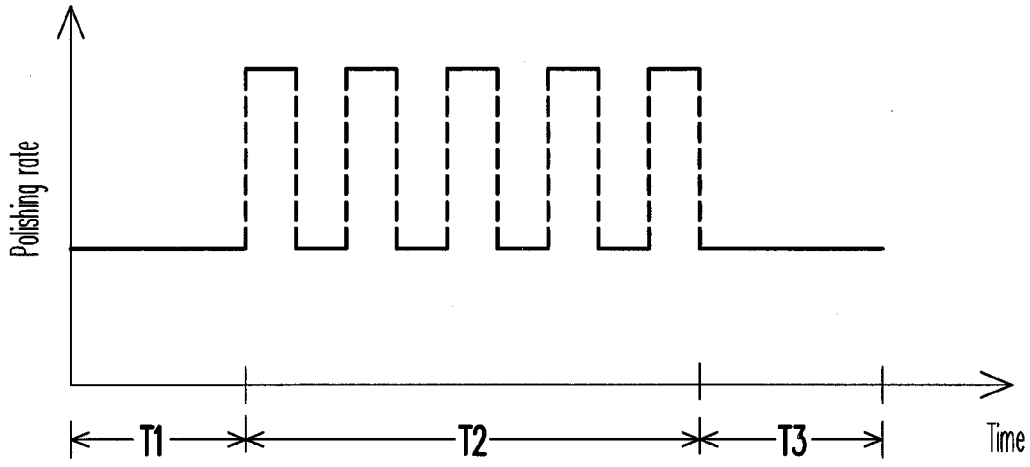
FIG. 5B is a graph showing a relationship of a polishing rate at a rotational center of a polishing article versus time when applying the polishing system in FIG. 4 to perform a second polishing process according to another embodiment of the invention.

FIG. 5A is a graph showing a relationship of a polishing rate at a rotational center of a polishing article versus time when applying the polishing system in FIG. 4 to perform the first polishing process according to an embodiment of the invention. FIG. 5B is a graph showing a relationship of a polishing rate at a rotational center of a polishing article versus time when applying the polishing system in FIG. 4 to perform the second polishing process according to an embodiment of the invention.

Referring to FIG. 5A, in the present embodiment, the first polishing process performed for the polishing article 10 on the first polishing pad 100 includes an initial polishing step and an oscillatory polishing step. In other words, when the first polishing process is performed for the polishing article 10 on the first polishing pad 100, the initial polishing step is first performed in the first time interval T1. At this time, as the rotational center C2 of the polishing article 10 almost constantly contacts the first high polishing rate region 104 of the first polishing pad 100 (that is, the polishing layer surface 104*a*), the rotational center C2 of the polishing article 10 polishes at a relatively higher polishing rate in the first time interval T1. Thereafter, the oscillatory polishing step O1 is performed in the second time interval T2. At this time, since the rotational center of the polishing article 10 oscillates back and forth between the position C2-1 and the position C2-2, the rotational center C2 of the polishing article 10 then contacts the first high polishing rate region 104 (that is, the polishing layer surface 104*a*) and the first low polishing rate region 102 (that is, the groove 102*a*) repetitively for polishing in the second time interval T2.

After the second time interval T2, a final polishing step is further performed in a third time interval T3. In the third time interval T3, as the rotational center C2 of the polishing article 10 almost constantly contacts the first high polishing rate region 104 of the first polishing pad 100 (that is, the polishing layer surface 104*a*), the rotational center C2 of the polishing article 10 polishes at a relatively higher polishing rate in the third time interval T3.

Accordingly, after the first polishing process is performed for the polishing article 10 on the first polishing pad 100, the polishing article 10 is then moved to the second polishing pad 200 to perform the second polishing process.

Referring to FIG. 5B, in the present embodiment, the second polishing process performed for the polishing article 10 on the second polishing pad 200 also includes an initial polishing step and an oscillatory polishing step. In other words, when the second polishing process is performed for the polishing article 10 on the second polishing pad 200, the initial polishing step is first performed in the first time interval T1. At this time, as the rotational center C2 of the polishing article 10 almost constantly contacts the second low polishing rate region 202 of the second polishing pad 200 (that is, the groove 202*a*), the rotational center C2 of the polishing article 10 polishes at a relatively lower polishing rate in the first time interval T1. Thereafter, the oscillatory polishing step O2 is performed in the second time interval T2. At this time, since the rotational center C2 of the polishing article 10 oscillates back and forth between the position C2-1 and the position C2-2, the rotational center C2 of the polishing article 10 then contacts the second high polishing rate region 204 and the second low polishing rate region 202 repetitively for polishing in the second time interval T2.

After the second time interval T2, a final polishing step is further performed in the third time interval T3. In the third time interval T3, as the rotational center C2 of the polishing article 10 almost constantly contacts the second low polishing rate region 202 of the second polishing pad 200 (that is, the groove 202*a*), the rotational center C2 of the polishing article 10 polishes in a relatively lower polishing rate in the third time interval T3.

In the embodiments of FIGS. 4, 5A and 5B, the rotational center C2 of the polishing article 10 almost always polishes at a relatively higher polishing rate in the initial polishing step (and the final polishing step) of the first polishing process. Also, the rotational center C2 of the polishing article 10 almost always polishes at a relatively lower polishing rate in the initial polishing step (and the final polishing step) of the second polishing process. Therefore, after the first and the second polishing processes are performed, the polishing rates of the rotational center C2 of the polishing article 10 compensate each other and the compensated polishing rate approaches the polishing rates of other positions of the polishing article 10, such that a better uniformity of the polishing rate on the surface of the polishing article 10 is attained.

Second Embodiment

Figure 6:
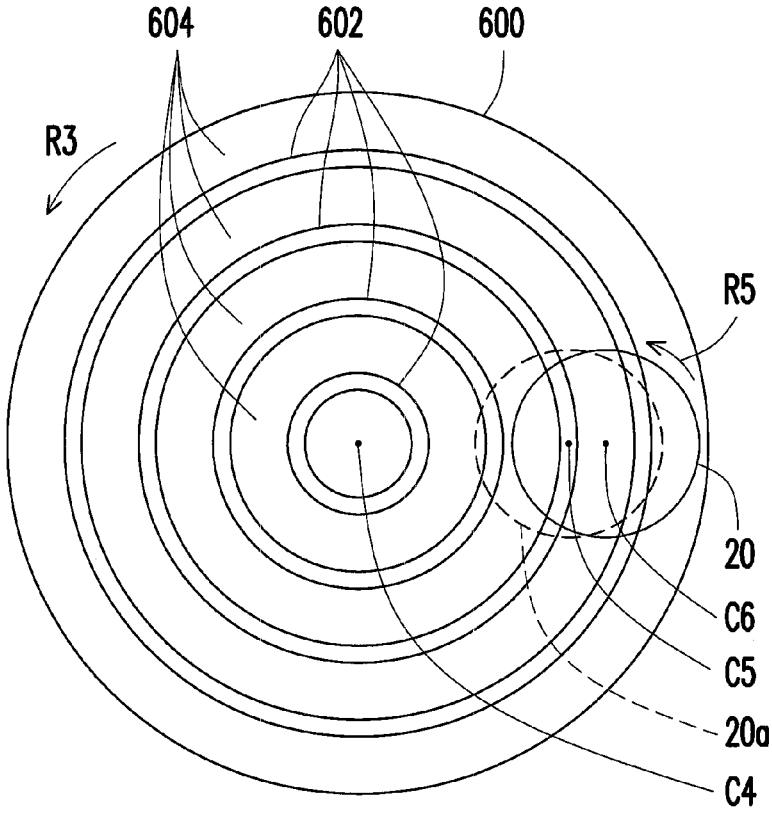
FIG. 6 illustrates a schematic top view of a polishing system according to an embodiment of the invention.

FIG. 6 illustrates a schematic top view of a polishing system according to an embodiment of the invention. Referring to FIG. 6, the polishing system in the present embodiment includes a polishing pad 600 and a polishing article 20. According to the present embodiment, the polishing system further includes a platen (not shown) configured to carry the polishing pad 600 and a carrier (not shown) configured to hold the polishing article 20.

The polishing pad 600 has a plurality of high polishing rate regions 604 and a plurality of low polishing rate regions 602. According to the present embodiment, at least one groove (similar to the groove 102*a* in FIG. 2) is disposed in the low polishing rate regions 602 of the polishing pad 600, and the high polishing rate regions 604 of the polishing pad 600 have a polishing layer surface (similar to the polishing layer surface 202*a* in FIG. 2). In addition, the high polishing rate regions 604 and the low polishing rate regions 602 are concentric circular regions respectively, and the high polishing rate regions 604 and the low polishing rate regions 602 are disposed alternately. In the present embodiment, the material used for forming the polishing pad 600 and the type of the grooves in the low polishing rate regions 602 are identical or similar to those described in the first embodiment, and the details thereof are thus omitted hereinafter.

The polishing pad 600 is driven by the platen, so that the polishing pad 600 rotates along a direction R3. The polishing article 20 is pressed onto the polishing pad 600 through the carrier. The carrier enables the polishing article 20 to rotate on the polishing pad 600, and drives an oscillatory movement shifting the polishing article 20 back and forth on the first polishing pad 600. Therefore, the contact between the polishing article 20 and the polishing pad 600 may not be confined within a certain region.

Accordingly, detailed steps of a polishing method performed using the polishing system mentioned above are provided below.

Firstly, the polishing article 20 is pressed onto the polishing pad 600 to perform a first polishing process. Particularly, a rotational center C6 of the polishing article 20 corresponds to one of the high polishing rate regions 604. In details, the polishing pad 600 rotates along the direction R3 during the first polishing process. Here, rotating along the direction R3 is, for example, rotating in a counter-clockwise direction along a rotational center C4 of the polishing pad 600. Moreover, the polishing article 20 rotates along the direction R5. Herein, rotating along the direction R5 is, for example, rotating in a counter-clockwise direction along a rotational center C6 of the polishing article 20. In the first polishing process, the rotational center C6 of the polishing article 20 constantly corresponds to the high polishing rate region 604 of the polishing pad 600. Since the rotational center C6 of the polishing article 20 almost constantly contacts the same position during the first polishing process, the rotational center C6 of the polishing article 20 polishes at a relatively higher polishing rate in the first polishing process.

Upon completion of the first polishing process, the carrier moves the polishing article 20 to a position 20*a*, such that the rotational center C5 is set corresponding to one of the low polishing rate regions 602 when the polishing article 20 is in position 20*a* to perform a second polishing process. More specifically, the polishing pad 600 rotates along the direction R3 and the polishing article 20 rotates along the direction R5 in the position 20*a* during the second polishing process. In the second polishing process, the rotational center C5 of the polishing article 20 at the position 20*a* constantly corresponds to the low polishing rate region 602 of the polishing pad 600. Since the rotational center C5 of the polishing article 20 in the position 20*a* almost constantly contacts the same position during the second polishing process, the rotational center C5 of the polishing article 20 in the position 20*a* polishes at a relatively lower polishing rate in the second polishing process.

Figure 7:
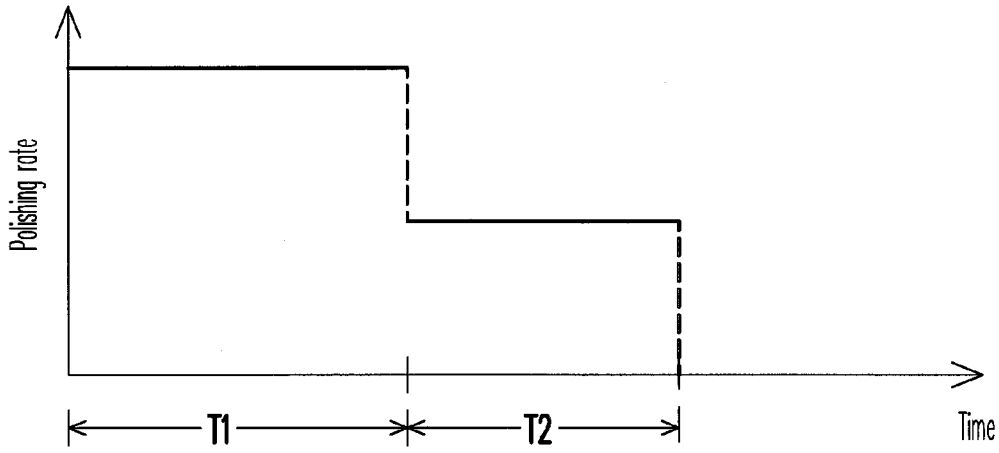
FIG. 7 is a graph showing a relationship of a polishing rate at a rotational center of a polishing article versus time when the polishing system in FIG. 6 performs a polishing process.

FIG. 7 is a graph showing a relationship of a polishing rate at a rotational center of a polishing article versus time when the polishing system in FIG. 6 performs a polishing process. According to an embodiment of the invention, referring to FIG. 7, a polishing time of the polishing article 20 performing the first polishing process on the polishing pad 600 is T1, and a polishing time of the polishing article 20 performing the second polishing process on the polishing pad 600 is T2. Particularly, the polishing time T1 in the first polishing process accounts for 10%-90% (or 20%-80%, 30%-70%, 40%-60%, or even 50%) of a total polishing time T1+T2.

Accordingly, as shown in FIG. 7, the rotational center of the polishing article 20 polishes at a relatively higher polishing rate during the first polishing process (that is, in the polishing time T1 interval). This is due to that the rotational center of the polishing article 20 almost constantly contacts the high polishing rate region 604 of the polishing pad 600 during the first polishing process. The rotational center of the polishing article 20 polishes at a relatively lower polishing rate during the second polishing process (that is, in the polishing time T2 interval). This is due to that the rotational center of the polishing article 20 almost constantly contacts the low polishing rate region 602 of the polishing pad 600 during the second polishing process. In other words, the polishing rate of the rotational center of the polishing article 20 in the first polishing process can be compensated with the polishing rate of the rotational center of the polishing article 20 in the second polishing process. Therefore, after the first and the second polishing processes are performed, the polishing rate of the rotational center of the polishing article 20 approaches the polishing rates at other positions of the polishing article 20, such that a better uniformity of the polishing rate on the surface of the polishing article 20 is attained.

Figure 8:
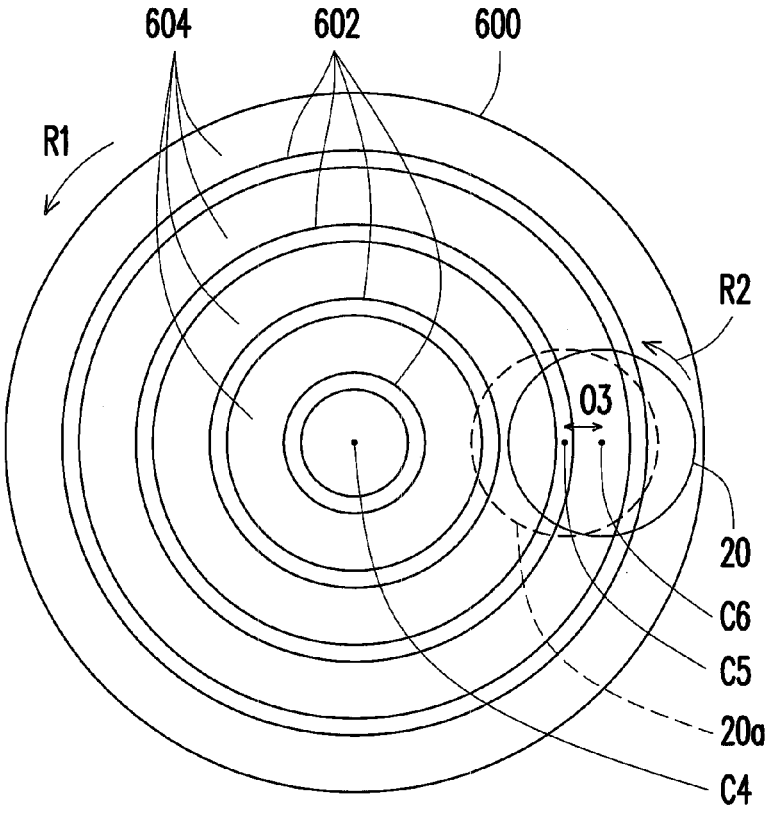
FIG. 8 illustrates a schematic top view of a polishing system according to another embodiment of the invention.
Figure 9:
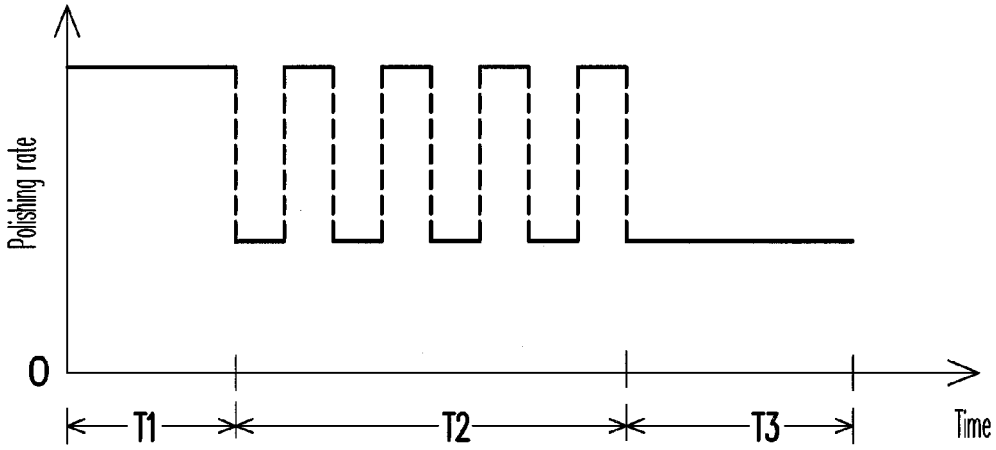
FIG. 9 is a graph showing a relationship of a polishing rate at a rotational center of a polishing article versus time when applying the polishing system in FIG. 8 to perform a polishing process according to an embodiment of the invention.

FIG. 8 illustrates a schematic top view of a polishing system according to another embodiment of the invention. Referring to FIG. 8, a polishing system in FIG. 8 is similar to the polishing system in FIG. 6, and the same elements as those in FIG. 6 are denoted with the same notations and the details are omitted hereinafter. The polishing system in FIG. 8 and the polishing system in FIG. 6 are different in that an oscillatory polishing step is further performed for the polishing article 20 in the polishing process. According to the present embodiment, after performing the first polishing process and before performing the second polishing process, an oscillatory polishing step O3 is further performed for the polishing article 20. In the oscillatory polishing step O3, the polishing article 20 rotates along the direction R2 and oscillates back and forth between a position 20 and a position 20*a* for polishing. FIG. 9 is a graph showing a relationship of a polishing rate at a rotational center of a polishing article versus time when applying the polishing system in FIG. 8 to perform a polishing process according to an embodiment of the invention. Referring to FIG. 9, in the present embodiment, when the first polishing process is performed for the polishing article 20 on the polishing pad 600 (that is, in the first time interval T1), as the rotational center of the polishing article 20 almost constantly contacts the high polishing rate region 604 of the polishing pad 600, the rotational center of the polishing article 20 then polishes at a relatively higher polishing rate in the first time interval T1. Afterwards, the oscillatory polishing step is performed in the second time interval T2. At this time, the rotational center of the polishing article 20 oscillates back and forth between a position. C6 and a position C5. Consequently, the rotational center of the polishing article 20 then contacts the high polishing rate region 604 and the low polishing rate region 602 repetitively for polishing in the second time interval T2. After the oscillatory polishing step (that is, the second time interval T2) is performed, the second polishing process (that is, the third time interval T3) is carried out. In the second polishing process (that is, the third time interval T3), as the rotational center of the polishing article 20 almost constantly contacts the low polishing rate region 602 of the polishing pad 600, the rotational center of the polishing article 20 thus polishes at a relatively lower polishing rate in the third time interval T3.

In the embodiments of FIGS. 8 and 9, the rotational center of the polishing article 20 almost always polishes at a relatively higher polishing rate in the first polishing process. Also, the rotational center of the polishing article 20 almost always polishes at a relatively lower polishing rate in the second polishing process. Therefore, after the first polishing process, the oscillatory polishing process, and the second polishing processes are performed, the polishing rate of the rotational center of the polishing article 20 approaches the polishing rates at other positions of the polishing article 20, such that a better uniformity of the polishing rate on the surface of the polishing article 20 is attained.

In the embodiments aforementioned, the rotational center of the polishing article 20 polishes at a relatively higher polishing rate in the first polishing process and the rotational center of the polishing article 20 polishes at a relatively lower polishing rate in the second polishing process. Nevertheless, the invention is not limited thereto. In another optional embodiment, the rotational center of the polishing article 20 polishes at a relatively lower polishing rate in the first polishing process, and the rotational center of the polishing article 20 polishes at a relatively higher polishing rate in the second polishing process. In particular, the polishing rate of the rotational center of the polishing article 20 in the first polishing process can be compensated with the polishing rate of the rotational center of the polishing article 20 in the second polishing process. Therefore, after the first and the second polishing processes are performed, the polishing rate of the rotational center of the polishing article 20 approaches the polishing rates at other positions of the polishing article 20, such that a better uniformity of the polishing rate on the surface of the polishing article 20 is attained.

Third Embodiment

Figure 10B:
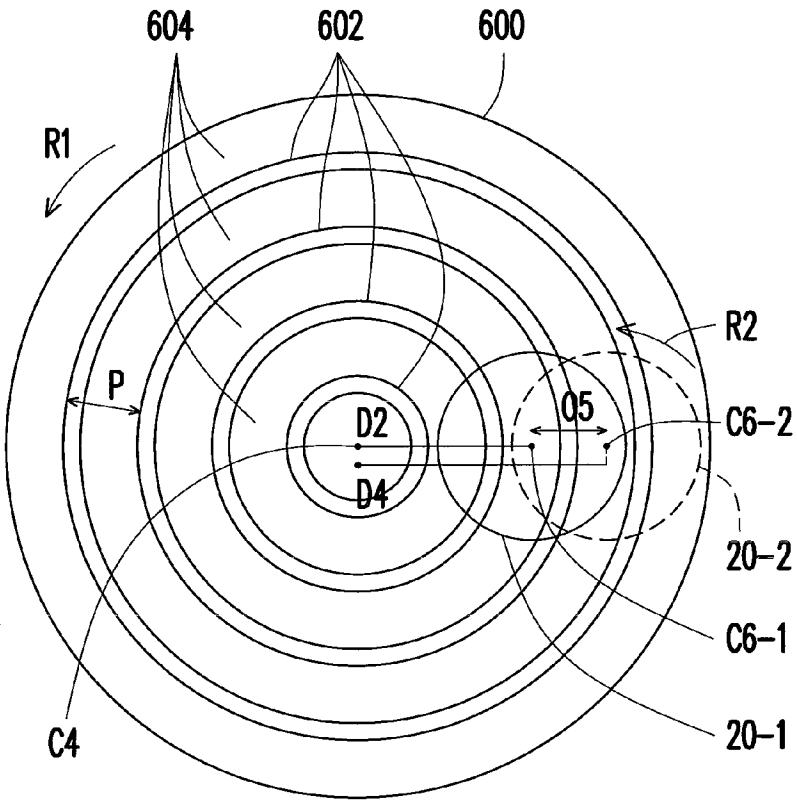
FIGS. 10A and 10B are schematic top views illustrate a polishing system according to another embodiment of the invention.
Figure 10A:
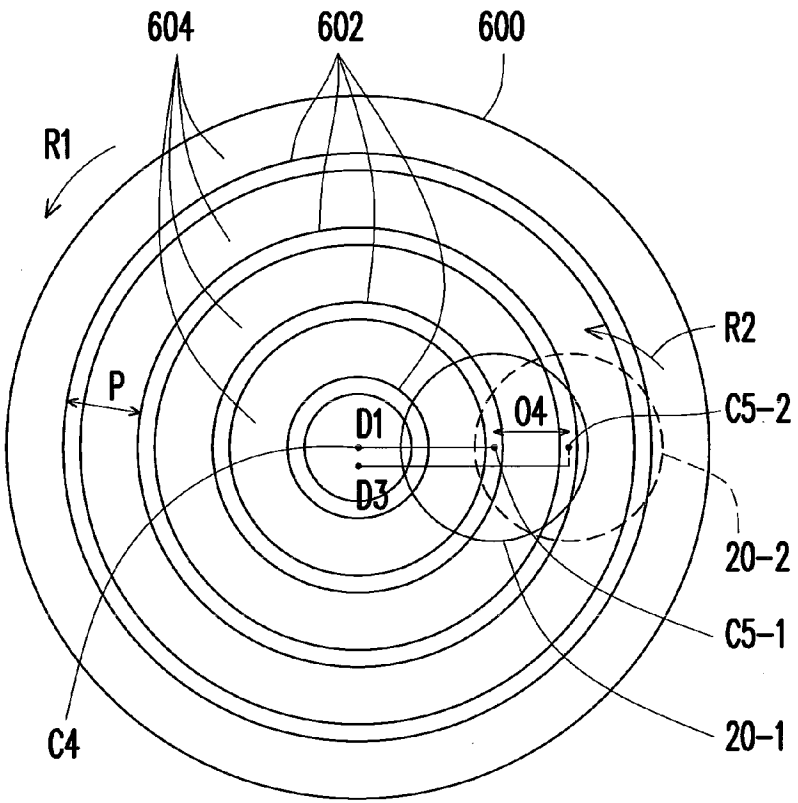

FIGS. 10A and 10B illustrate schematic top views of a polishing system according to another embodiment of the invention. Referring to FIGS. 10A and 10B, a polishing system in FIGS. 10A and 10B is similar to the polishing system in FIG. 6, and the same elements as those in FIG. 6 are denoted with the same notations and the details are omitted hereinafter. The polishing system in FIGS. 10A and 10B is different from the polishing system in FIG. 6 in that polishing processes of the polishing article are all oscillatory polishing processes.

In details, when a first polishing process is performed for the polishing article 20 on the polishing pad 600, the first polishing process is a first oscillatory polishing process O4, so that the polishing article 20 oscillates back and forth between a position 20-1 and a position 20-2 and the rotational center of the polishing article 20 oscillates between a position C5-1 and a position C5-2.

In the first oscillatory polishing process O4, the rotational center C4 of the polishing pad 600 and the rotational center of the polishing article 20 have a first shortest distance D1 and a first longest distance D3 therebetween. In other words, when the polishing article 20 oscillates to the position 20-1, the rotational center of the polishing article 20 also shifts to the position C5-1. At this time, the rotational center C4 of the polishing pad 600 and the rotational center C5-1 of the polishing article 20 have the distance D1 therebetween. When the polishing article 20 oscillates to the position 20-2, the rotational center of the polishing article 20 also shifts to the position C5-2. Here, the rotational center C4 of the polishing pad 600 and the rotational center C5-2 of the polishing article 20 have the distance D3 therebetween.

After the first oscillatory polishing process illustrated in FIG. 10A is performed, a second polishing process is subsequently performed for the polishing article 20 on the same polishing pad 600. The second polishing process is a second oscillatory polishing process as shown in FIG. 10B. In details, when a second oscillatory polishing process O5 is performed for the polishing article 20 on the polishing pad 600, the polishing article 20 then oscillates between the position 20-1 and the position 20-2. Moreover, the rotational center of the polishing article 20 also oscillates between a position C6-1 and a position C6-2.

In the second oscillatory polishing process O5, the rotational center C4 of the polishing pad 600 and the rotational center of the polishing article 20 have a second shortest distance D2 and a second longest distance D4 therebetween. In other words, when the polishing article 20 oscillates to the position 20-1, the rotational center of the polishing article 20 also shifts to the position C6-1. At this time, the rotational center C4 of the polishing pad 600 and the rotational center C6-1 of the polishing article 20 have the distance D2 therebetween. When the polishing article 20 oscillates to the position C6-2, the rotational center C4 of the polishing article 20 also shifts to the position C6-2. Here, the rotational center C4 of the polishing pad 600 and the rotational center C6-2 of the polishing article 20 have the distance D4 therebetween.

Especially, when the polishing article 20 undergoes the first oscillatory polishing process O4 and the second oscillatory polishing process O5, the shortest distance D1 or D2 between the rotational center C4 of the polishing pad 600 and the rotational center (C5-1, C6-1) of the polishing article 20 satisfies the following relation:

$$D1-D2=P\times N+P\times(30\%\sim70\%)$$

P is a distance between two adjacent low polishing rate regions 602

N is an integer

In the above relation, the percentage interval ranges from 30% to 70%; however, the scope of the invention is not limited thereto. The percentage interval can be adjusted depending on the distance P or the width of the low polishing regions 602 (that is, the width of the grooves). When the width of the low polishing rate regions 602 accounts for a small percentage of the distance P (that is, the width of the grooves is far smaller than the distance P), the percentage interval in the relation is then optionally 20%-80%, or even 10%-90%. On the contrary, when the width of the low polishing rate regions 602 accounts for a large percentage of the distance P, the percentage interval in the relation is then optionally 40%-60% or even 50%.

Furthermore, when the polishing article 20 undergoes the first oscillatory polishing process O4 and the second oscillatory polishing process O5, the longest distance D3 or D4 between the rotational center C4 of the polishing pad 600 and the rotational center (C5-2, C6-2) of the polishing article 20 satisfies the following relation:

$$D3-D4=P\times N+P\times(30\%\sim70\%).$$

P is a distance between two adjacent low polishing rate regions 602

N is an integer

In the above relation, the percentage interval ranges from 30% to 70%; however, the scope of the invention is not limited thereto. The percentage interval can be adjusted depending on the distance P or the width of the low polishing regions 602 (that is, the width of the grooves). When the width of the low polishing rate regions 602 accounts for a small percentage of the distance P (that is, the width of the grooves is far smaller than the distance P), the percentage interval in the relation is then optionally 20%-80%, or even 10%-90%. On the contrary, when the width of the low polishing rate regions 602 accounts for a large percentage of the distance P, the percentage interval in the relation is then optionally 40%-60% or even 50%.

Figure 11:
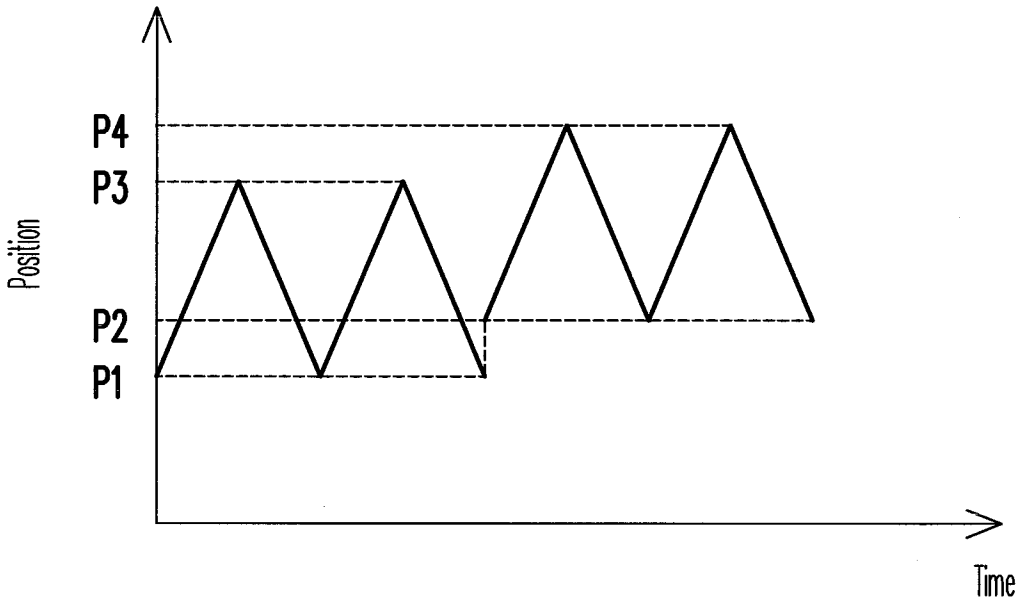
FIG. 11 is a graph showing a relationship of positions of a rotational center of a polishing article versus time when applying the polishing system in FIGS. 10A and 10B to perform a polishing process according to an embodiment of the invention.

In other words, when the polishing article 20 in the present embodiment performs the first oscillatory polishing process (as shown in FIG. 10A) and the second oscillatory polishing process (as shown in FIG. 10B), oscillatory positions of the rotational center thereof are not overlapped (that is, are staggered) as depicted in FIG. 11. FIG. 11 is a graph showing a relationship of positions of a rotational center of a polishing article versus time when applying the polishing system in FIGS. 10A and 10B to perform a polishing process according to an embodiment of the invention. In FIG. 11, when the polishing article 20 performs the first oscillatory polishing process (as shown in FIG. 10A), the position of the rotational center oscillates back and forth between a position P1 and a position P3. When the polishing article 20 performs the second oscillatory polishing process (as shown in FIG. 10B), the position of the rotational center oscillates back and forth between a position P2 and a position P4.

As illustrated in FIG. 11, the position P1 of the rotational center of the polishing article 20 during the first oscillatory polishing process and the position P2 of the rotational center of the polishing article 20 during the second oscillatory polishing process are not overlapped. The distance between the position P1 and the position P2 is the value of D1−D2 aforementioned, which equals to P×N+P×(30%~70%). Similarly, the position P3 of the rotational center of the polishing article 20 during the first oscillatory polishing process and the position P4 of the rotational center of the polishing article 20 during the second oscillatory polishing process are not overlapped. The distance between the position P3 and the position P4 is the value of D3−D4 aforementioned, which equals to P×N+P×(30%~70%).

In the present embodiment, as the position P1 of the rotational center of the polishing article 20 during the first oscillatory polishing process and the position P2 of the rotational center of the polishing article 20 during the second oscillatory polishing process are not overlapped, the polishing rates of the rotational center of the polishing article 20 in the first and the second oscillatory polishing processes can be compensated. The polishing rate of the rotational center of the polishing article 20 therefore approaches the polishing rates at other positions of the polishing article 20, such that a better uniformity of the polishing rate on the surface of the polishing article 20 is attained.

According to another embodiment of the invention, the embodiments in the FIGS. 10A and 10B can also be applied in combination with the second embodiment (FIGS. 6 and 8). In other words, in the present embodiment, the above-mentioned polishing process includes the first oscillatory polishing process and the second oscillatory polishing process shown in FIGS. 10A and 10B, and can optionally determine an initial position of the polishing article 20 in the first polishing process and an initial position of the polishing article in the second polishing process. In other words, the initial position of the polishing article 20 in the first polishing process is fixed for the rotational center C5 of the polishing article 20 to be set corresponding to one of the low polishing rate regions 602 (grooves). Additionally, the initial position of the polishing article 20 in the second polishing process is fixed for the rotational center C6 of the polishing article 20 to be set corresponding to one of the high polishing rate regions 604 (the polishing layer surface).

Hence, the position P1 of the rotational center of the polishing article 20 during the first oscillatory polishing process (as shown in FIG. 10A) and the position P2 of the rotational center of the polishing article 20 during the second oscillatory polishing process (as shown in FIG. 10B) are not overlapped. Further, the initial position of the polishing article 20 in the first polishing process is fixed for the rotational center C5 of the polishing article 20 to be set corresponding to one of the low polishing rate regions 602. The initial position of the polishing article 20 in the second polishing process is fixed for the rotational center C6 of the polishing article 20 to be set corresponding to one of the high polishing rate regions 604. Therefore, the polishing rates of the rotational center of the polishing article 20 in the first polishing process and the second polishing process can be compensated by adopting the polishing system and the polishing method of the present embodiment. As a result, the polishing rate of the rotational center of the polishing article 20 approaches the polishing rates at other positions of the polishing article 20, such that a better uniformity of the polishing rate on the surface of the polishing article 20 is attained.

In the embodiment above, the first polishing process is illustrated with FIG. 10A and the second polishing process is illustrated with FIG. 10B. However, the scope of the invention is not limited thereto. In another optional embodiment, the first polishing process can be changed to the process displayed in FIG. 10B while the second polishing process is changed to the process shown in FIG. 10A. Specifically, the polishing rates of the rotational center of the polishing article 20 in the first polishing process and the second polishing process can be compensated, so that the polishing rate of the rotational center of the polishing article 20 approaches the polishing rates at other positions of the polishing article 20, such that a better uniformity of the polishing rate on the surface of the polishing article 20 is attained.

The polishing system and the polishing method in the embodiments aforementioned can be applied in the polishing apparatuses used in the fabrications of devices involved in semiconductors, integrated circuits, micro-electromechanics, communication, optics, storage disks, and displays and also the fabrication processes thereof. The polishing articles used for fabricating the devices include semiconductor wafers, group III-V wafers, storage device carriers, ceramic substrates, high polymer substrate, glass substrate, and so on; however, the scope of the invention is not limited thereto.

It will be apparent to those skilled in the art that various modifications and variations can be made to the structure of the disclosed embodiments without departing from the scope or spirit of the invention. In view of the foregoing, it is intended that the invention cover modifications and variations of this invention provided they fall within the scope of the following claims and their equivalents.

What is claimed is:

1. A polishing method, comprising:

providing a first polishing pad having a plurality of first high polishing rate regions and a plurality of first low polishing rate regions, the plurality of first high polishing rate regions comprising a first plurality of lands, and the plurality of first low polishing rate regions comprising a first plurality of grooves, wherein the lands and grooves of the first polishing pad are in an alternating pattern;

providing a second polishing pad having a plurality of second high polishing rate regions and a plurality of second low polishing rate regions, the plurality of second high polishing rate regions comprising a second plurality of lands, and the plurality of second low polishing rate regions comprising a second plurality of grooves, wherein the lands and grooves of the second polishing pad are in an alternating pattern;

setting a polishing article on the first polishing pad to perform a first polishing process; and moving the polishing article onto the second polishing pad to perform a second polishing process, wherein a rotational center of the polishing article is constantly corresponding to one of the first high polishing rate regions during the entirety of the first polishing process and is constantly corresponding to one of the second low polishing rate regions during the entirety of the second polishing process; or the rotational center of the polishing article is constantly corresponding to one of the first low polishing rate regions during the entirety of the first polishing process and is constantly corresponding to one of the second high polishing rate regions during the entirety of the second polishing process.

2. The polishing method as claimed in claim 1, wherein a polishing time of the first polishing process accounts for 30%-70% of a total polishing time.

3. The polishing method as claimed in claim 1, wherein at least one first groove is disposed in the first low polishing rate regions of the first polishing pad, and the first high polishing rate regions have a first polishing layer surface; and at least one second groove is disposed in the second low polishing rate regions of the second polishing pad, and the second high polishing rate regions have a second polishing layer surface.

4. The polishing method as claimed in claim 1, wherein the first high polishing rate regions and the first low polishing rate regions of the first polishing pad are concentric circular regions respectively, and the first high polishing rate regions and the first low polishing rate regions are disposed alternately.

5. The polishing method as claimed in claim 1, wherein the second high polishing rate regions and the second low polishing rate regions of the second polishing pad are concentric circular regions respectively, and the second high polishing rate regions and the second low polishing rate regions are disposed alternately.

6. The polishing method as claimed in claim 1, wherein the first polishing process is an initial polishing step, and when performing the initial polishing step, the rotational center of the polishing article corresponds to one of the first high polishing rate regions or one of the first low polishing rate regions; and after the initial polishing step, an oscillatory polishing step is performed.

7. The polishing method as claimed in claim 1, wherein the second polishing is an initial polishing step, and when performing the initial polishing step, the rotational center of the polishing article corresponds to one of the second low polishing rate regions or one of the second high polishing rate regions; and after the initial polishing step, an oscillatory polishing step is performed.

8. The polishing method as claimed in claim 1, wherein the first and second polishing pads have the same configuration and the rotation center of the polishing article has different corresponding positions relative to a rotational center of the first polishing pad and a rotational center of the second polishing pad.

9. A polishing method, comprising:

providing a polishing pad having a plurality of high polishing rate regions and a plurality of low polishing rate regions, the plurality of high polishing rate regions comprising a plurality of lands, and the plurality of low polishing rate regions comprising a plurality of grooves, wherein the lands and grooves of the polishing pad are in an alternating pattern;

setting a polishing article, held by a carrier, on the polishing pad to perform a first polishing process by pressing the polishing article onto the polishing pad, via the carrier, in a first position;

and moving the polishing article, by moving the carrier, to perform a second polishing process upon completion of the first polishing process by pressing the polishing article onto the polishing pad, via the carrier, in a second position, wherein a rotational center of the polishing article is constantly corresponding to one of the high polishing rate regions during the entirety of the first polishing process and is constantly corresponding to one of the low polishing rate regions during the entirety of the second polishing process; or the rotational center of the polishing article is constantly corresponding to one of the low polishing rate regions during the entirety of the first polishing process and is constantly corresponding to one of the high polishing rate regions during the entirety of the second polishing process; and wherein during each of the first and second polishing processes, the polishing article rotates but does not oscillate, and wherein the polishing article may be only in the first position or only in the second position when performing the polishing processes, the polishing article being lifted from the polishing pad between the first position and the second position.

10. The polishing method as claimed in claim 9, wherein a polishing time of the first polishing process accounts for 10%-90% of a total polishing time, wherein the total polishing time is equal to the polishing time of the first polishing process and a polishing time of the second polishing process.

11. The polishing method as claimed in claim 9, wherein at least one groove is disposed in the low polishing rate regions, and the high polishing rate regions have a polishing layer surface.

12. The polishing method as claimed in claim 9, wherein the high polishing rate regions and the low polishing rate regions are concentric circular regions respectively, and the high polishing rate regions and the low polishing rate regions are disposed alternately.

13. The polishing method as claimed in claim 9, wherein after the first polishing process is performed and before the second polishing process is performed, the polishing method further comprises an oscillatory polishing process.

14. The polishing method as claimed in claim 9, further comprising:

performing a first oscillatory polishing process and when performing the first oscillatory polishing process, a rotational center of the polishing pad and the rotational center of the polishing article have a first shortest distance D1 therebetween; and performing a second oscillatory polishing process and when performing the second oscillatory polishing process, the rotational center of the polishing pad and the rotational center of the polishing article have a second shortest distance D2 therebetween, and satisfying the following relation:

$$D1-D2=P\times N+P\times(30\%-70\%),$$

wherein P represents a distance between two adjacent low polishing rate regions and N represents an integer.

15. The polishing method as claimed in claim 14, wherein when performing the first oscillatory polishing process, the rotational center of the polishing pad and the rotational center of the polishing article have a first longest distance D3 therebetween;

when performing the second oscillatory polishing process, the rotational center of the polishing pad and the rotational center of the polishing article have a second longest distance D4 therebetween, and satisfying the following relation:

$$D3-D4=P\times N+P\times(30\%-70\%),$$

wherein P represents a distance between two adjacent low polishing rate regions and N represents an integer.

16. A polishing method, comprising:

providing a polishing pad having a plurality of high polishing rate regions and a plurality of low polishing rate regions, the plurality of high polishing rate regions comprising a plurality of lands, and the plurality of low polishing rate regions comprising a plurality of grooves, wherein the lands and grooves of the polishing pad are in an alternating pattern;

setting a polishing article, held by a carrier, on the polishing pad to perform a first oscillatory polishing process by pressing the polishing article onto the polishing pad, via the carrier, in a first position and when performing the first oscillatory polishing process, a rotational center of the polishing pad and a rotational center of the polishing article have a first shortest distance D1 therebetween; and setting the polishing article on the same polishing pad, by moving the carrier, to perform a second oscillatory polishing process after completion of the first oscillatory polishing process, by pressing the polishing article onto the polishing pad, via the carrier, in a second position, wherein when performing the second oscillatory polishing process, the rotational center of the polishing pad and the rotational center of the polishing article have a second shortest distance D2 therebetween, and satisfying the following relation:

$$D1-D2=P\times N+P\times(30\%-70\%),$$

wherein P represents a distance between two adjacent low polishing rate regions and N represents an integer, and the rotational center of the polishing article is only corresponding to one of the low polishing rate regions when the first shortest distance D1 is established during the first oscillatory polishing process, and the rotational center of the polishing article is only corresponding to one of the high polishing rate regions when the second shortest distance D2 is established during the second oscillatory polishing process, or the rotational center of the polishing article is only corresponding to one of the high polishing rate regions when the first shortest distance D1 is established during the first oscillatory polishing process, and the rotational center of the polishing article is only corresponding to one of the low polishing rate regions when the second shortest distance D2 is established during the second oscillatory polishing process, wherein the polishing article may be only in the first position or only in the second position when performing the polishing processes, the polishing article being lifted from the polishing pad between the first position and the second position.

17. The polishing method as claimed in claim 16, wherein at least one groove is disposed in the low polishing rate regions, and the high polishing rate regions have a polishing layer surface.

18. The polishing method as claimed in claim 16, wherein the high polishing rate regions and the low polishing rate regions are concentric circular regions respectively, and the high polishing rate regions and the low polishing rate regions are disposed alternately.

19. The polishing method as claimed in claim 16, wherein when performing the first oscillatory polishing process, the rotational center of the polishing pad and the rotational center of the polishing article have a first longest distance D3 therebetween;

when performing the second oscillatory polishing process, the rotational center of the polishing pad and the rotational center of the polishing article have a second longest distance D4 therebetween, and satisfying the following relation:

$$D3-D4=P\times N+P\times(30\%-70\%),$$

wherein P represents a distance between two adjacent low polishing rate regions and N represents an integer.

20. The polishing method as claimed in claim 16, wherein a polishing time of the first oscillatory polishing process accounts for 10%-90% of a total polishing time, wherein the total polishing time is equal to the polishing time of the first oscillatory polishing process and a polishing time of the second oscillatory polishing process.

21. A polishing system suitable for polishing a polishing article, the polishing system comprising:

a first polishing pad having a plurality of first high polishing rate regions and a plurality of first low polishing rate regions, the plurality of first high polishing rate regions comprising a first plurality of lands, and the plurality of first low polishing rate regions comprising a first plurality of grooves, wherein the lands and grooves of the first polishing pad are in an alternating pattern; and a second polishing pad having a plurality of second high polishing rate regions and a plurality of second low polishing rate regions, the plurality of second high polishing rate regions comprising a second plurality of lands, and the plurality of second low polishing rate regions comprising a second plurality of grooves, wherein the lands and grooves of the second polishing pad are in an alternating pattern, wherein when the polishing article is set on the first polishing pad to perform a first polishing process, a rotational center of the polishing article is constantly corresponding to one of the first high polishing rate regions, and when the polishing article is moved onto the second polishing pad to perform a second polishing process, the rotational center of the polishing article is constantly corresponding to one of the second low polishing rate regions; or when the polishing article is set on the first polishing pad to perform a first polishing process, a rotational center of the polishing article is constantly corresponding to one of the first low polishing rate regions during the entirety of the first polishing process, and when the polishing article is moved onto the second polishing pad to perform a second polishing process, the rotational center of the polishing article is constantly corresponding to one of the second high polishing rate regions during the entirety of the second polishing process.

22. The polishing system as claimed in claim 21, wherein a polishing time of the first polishing process accounts for 30%-70% of a total polishing time.

23. The polishing system as claimed in claim 21, wherein at least one first groove is disposed in the first low polishing rate regions of the first polishing pad, and the first high polishing rate regions have a first polishing layer surface; and at least one second groove is disposed in the second low polishing rate regions of the second polishing pad, and the second high polishing rate regions have a second polishing layer surface.

24. The polishing system as claimed in claim 21, wherein the first high polishing rate regions and the first low polishing rate regions of the first polishing pad are concentric circular regions respectively, and the first high polishing rate regions and the first low polishing rate regions are disposed alternately.

25. The polishing system as claimed in claim 21, wherein the second high polishing rate regions and the second low polishing rate regions of the second polishing pad are concentric circular regions respectively, and the second high polishing rate regions and the second low polishing rate regions are disposed alternately.

26. The polishing system as claimed in claim 21, wherein the first and second polishing pads have the same configuration and the rotation center of the polishing article has different corresponding positions relative to a rotational center of the first polishing pad and a rotational center of the second polishing pad.

27. A polishing system, comprising:

a polishing pad having a plurality of high polishing rate regions and a plurality of low polishing rate regions, the plurality of high polishing rate regions comprising a plurality of lands, and the plurality of low polishing rate regions comprising a plurality of grooves, wherein the lands and grooves of the polishing pad are in an alternating pattern; and a polishing article set on the polishing pad, wherein when the polishing article is set on the polishing pad to perform a first polishing process, a rotational center of the polishing article is constantly corresponding to one of the high polishing rate regions during the entirety of the first polishing process, and when the polishing article is set to the polishing pad to perform a second polishing process upon completion of the first polishing process, the rotational center of the polishing article is constantly corresponding to one of the low polishing rate regions during the entirety of the second polishing process; or when the polishing article is set on the polishing pad to perform a first polishing process, a rotational center of the polishing article is constantly corresponding to one of the low polishing rate regions during the entirety of the first polishing process, and when the polishing article is set on the polishing pad to perform a second polishing process upon completion of the first polishing process, the rotational center of the polishing article is constantly corresponding to one of the high polishing rate regions during the entirety of the second polishing process, wherein the polishing article is held by a carrier and setting the polishing article to perform a second polishing process comprises moving the carrier from a first position to a second position, and wherein the polishing article is pressed onto the polishing pad at a first position by the carrier at the start of the first polishing process and the polishing article is pressed onto the polishing pad by the carrier at a second position at the start of the second polishing process, and wherein the polishing article may be only in the first position or only in the second position when performing the polishing processes, the polishing article being lifted from the polishing pad between the first position and the second position.

28. The polishing system as claimed in claim 27, wherein at least one groove is disposed in the low polishing rate regions, and the high polishing rate regions have a polishing layer surface.

29. The polishing system as claimed in claim 27, wherein the high polishing rate regions and the low polishing rate regions are concentric circular regions respectively, and the high polishing rate regions and the low polishing rate regions are disposed alternately.

30. A polishing system, comprising:

a polishing pad having a plurality of high polishing rate regions and a plurality of low polishing rate regions, the plurality of high polishing rate regions comprising a plurality of lands, and the plurality of low polishing rate regions comprising a plurality of grooves, wherein the lands and grooves of the polishing pad are in an alternating pattern; and a polishing article, held by a carrier, set on the polishing pad, wherein when a first oscillatory polishing process is performed for the polishing article on the polishing pad, a rotational center of the polishing pad and a rotational center of the polishing article have a first shortest distance D1 therebetween; and after completion of the first oscillatory polishing process, when a second oscillatory polishing process is performed for the polishing article on the same polishing pad, by moving the carrier from a first position during the first oscillatory polishing process to a second position for performing the second oscillatory polishing process, the rotational center of the polishing pad and the rotational center of the polishing article have a second shortest distance D2 therebetween, and satisfying the following relation:

$$D1-D2=P\times N+P\times(30\%-70\%),$$

wherein P represents a distance between two adjacent low polishing rate regions and N represents an integer, and the rotational center of the polishing article is only corresponding to one of the low polishing rate regions when the first shortest distance D1 is established during the first oscillatory polishing process, and the rotational center of the polishing article is only corresponding to one of the high polishing rate regions when the second shortest distance D2 is established during the second oscillatory polishing process, or the rotational center of the polishing article is only corresponding to one of the high polishing rate regions when the first shortest distance D1 is established during the first oscillatory polishing process, and the rotational center of the polishing article is only corresponding to one of the low polishing rate regions when the second shortest distance D2 is established during the second oscillatory polishing process, wherein the polishing article is pressed onto the polishing pad at the first position by the carrier at the start of the first oscillatory polishing process and the polishing article is pressed onto the polishing pad by the carrier at the second position at the start of the second oscillatory polishing process, and wherein the polishing article may be only in the first position or only in the second position when performing the polishing processes, the polishing article being lifted from the polishing pad between the first position and the second position.

31. The polishing system as claimed in claim 30, wherein at least one groove is disposed in the low polishing rate regions, and the high polishing rate regions have a polishing layer surface.

32. The polishing system as claimed in claim 30, wherein the high polishing rate regions and the low polishing rate regions are concentric circular regions respectively, and the high polishing rate regions and the low polishing rate regions are disposed alternately.

33. The polishing system as claimed in claim 30, wherein when the first oscillatory polishing process is performed for the polishing article on the polishing pad, the rotational center of the polishing pad and the rotational center of the polishing article have a first longest distance D3 therebetween;

when the second oscillatory polishing process is performed for the polishing article on the polishing pad, the rotational center of the polishing pad and the rotational center of the polishing article have a second longest distance D4 therebetween, and satisfying the following relation:

$$D3-D4=P\times N+P\times(30\%-70\%),$$

wherein P represents a distance between two adjacent low polishing rate regions and N represents an integer.

34. The polishing system as claimed in claim 30, wherein a polishing time of the first oscillatory polishing process accounts for 10%-90% of a total polishing time, wherein the total polishing time is equal to the polishing time of the first oscillatory polishing process and a polishing time of the second oscillatory polishing process.

* * * * *